US008116459B2

(12) United States Patent
Disch et al.

(10) Patent No.: US 8,116,459 B2
(45) Date of Patent: Feb. 14, 2012

(54) ENHANCED METHOD FOR SIGNAL SHAPING IN MULTI-CHANNEL AUDIO RECONSTRUCTION

(75) Inventors: Sascha Disch, Fuerth (DE); Karsten Linzmeier, Erlangen (DE); Juergen Herre, Buckenhof (DE); Harald Popp, Tuchenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1274 days.

(21) Appl. No.: 11/384,000

(22) Filed: May 18, 2006

(65) Prior Publication Data

US 2007/0236858 A1 Oct. 11, 2007

Related U.S. Application Data

(60) Provisional application No. 60/787,096, filed on Mar. 28, 2006.

(51) Int. Cl.
*H04R 5/00* (2006.01)

(52) U.S. Cl. ..... 381/22; 381/23; 381/10; 704/501; 704/504

(58) Field of Classification Search ..... 381/1, 17–23, 381/119; 704/501, 503–504; 700/94; 369/4; 84/622, 629, 636, 659, 692
See application file for complete search history.

(56) References Cited

U.S. PATENT DOCUMENTS

| | | | |
|---|---|---|---|
| 6,502,069 | B1 | 12/2002 | Grill et al. |
| 2005/0058304 | A1 | 3/2005 | Baumgarte et al. |
| 2006/0239473 | A1 * | 10/2006 | Kjorling et al. ..... 381/98 |

FOREIGN PATENT DOCUMENTS

| | | | |
|---|---|---|---|
| EP | 0805435 | A2 | 11/1997 |
| RU | 2119259 | C1 | 9/1998 |
| RU | 2129336 | C1 | 4/1999 |
| RU | 2185024 | C2 | 7/2002 |
| TW | 569551 | | 1/2004 |
| TW | 200537436 | A | 11/2005 |
| TW | 200611240 | A | 4/2006 |
| WO | WO 9857436 | A2 * | 12/1998 |

(Continued)

OTHER PUBLICATIONS

Christof Faller et al, "Binaural Cue Coding Applied to Stereo and Multi-Channel Audio Compression", May 10-13, 2002, Audio Engineering Society (AES), presented at the 112$^{th}$ Convention, Munich, Germany, pp. 1-9.*

(Continued)

*Primary Examiner* — Vivian Chin
*Assistant Examiner* — Leshui Zhang
(74) *Attorney, Agent, or Firm* — Glenn Patent Group; Michael A. Glenn

(57) ABSTRACT

The present invention is based on the finding that a reconstructed output channel, reconstructed with a multi-channel reconstructor using at least one downmix channel derived by downmixing a plurality of original channels and using a parameter representation including additional information on a temporal fine structure of an original channel can be reconstructed efficiently with high quality, when a generator for generating a direct signal component and a diffuse signal component based on the downmix channel is used. The quality can be essentially enhanced, if only the direct signal component is modified such that the temporal fine structure of the reconstructed output channel is fitting a desired temporal fine structure, indicated by the additional information on the temporal fine structure transmitted.

30 Claims, 5 Drawing Sheets

FOREIGN PATENT DOCUMENTS

| | | | | |
|---|---|---|---|---|
| WO | WO 2004/097794 | A2 | | 11/2004 |
| WO | WO 2004097794 | A2 | * | 11/2004 |
| WO | WO 2006/026161 | A2 | | 3/2006 |
| WO | WO 2006048203 | A1 | * | 5/2006 |
| WO | WO 2006048227 | A1 | * | 5/2006 |
| WO | WO 2007/110101 | A1 | | 10/2007 |

OTHER PUBLICATIONS

Frank et al, "Design and Evaluation of Binaural Cue Coding Schemes", Oct. 5-8 2002, Audio Engineering Society (AES), presented at the 113th Convention, Los Angeles, CA, USA, pp. 1-15.*

C. Faller et al., "Efficient Representation of Spatial Audio Using Perceptual Parametrization," Proceedings in IEEE WASPAA, Mohonk, NY, Oct. 21-24, 2001, pp. 1-4.

F. Baumgarte et al., "Estimation of Auditory Spatial Cues for Binaural Cue Coding," Proceedings in ICASSP 2002, Orlando, FL, May 2002, pp. 1801-1804.

C. Faller et al, "Binaural Cue Coding: A Novel and Efficient Representation of Spatial Audio," Proceedings in ICASSP 2002, Orlando, FL, May 2002, pp. 1841-1844.

F. Baumgarte et al., "Why Binaural Cue Coding is Better Than Intensity Stereo Coding," Proceedings in AES 112th Convention, Munich, Germany, May 10-13, 2002, pp. 1-10.

C. Faller et al., "Binaural Cue Coding Applied to Stereo and Multi-Channel Audio Compression," Proceedings in, AES 112th Convention, Munich, Germany, May 10-13, 2002, pp. 1-9.

F. Baumgarte et al., "Design and Evaluation of Binaural Cue Coding Schemes," Proceedings in AES 113th Convention, Los Angeles, CA, Oct. 5-8, 2002, pp. 1-15.

C. Faller et al., "Binaural Cue Coding Applied to Audio Compression with Flexible Rendering," in Proceedings AES 113th Convention, Los Angeles, CA, Oct. 5-8, 2002, pp. 1-10.

J. Breebaart et al., "MPEG Spatial Audio Coding / MPEG Surround: Overview and Current Status," 119th AES Convention, New York, Oct. 7-10, 2005, Preprint 6599, pp. 1-17.

J. Herre, "The Reference Model Architecture for MPEG Spatial Audio Coding", 118th AES Convention, Barcelona May 28-31, 2005, Preprint 6477, pp. 1-13.

J. Herre et al., "Spatial Audio Coding: Next-Generation Efficient and Compatible Coding of Multi-Channel Audio," Proceedings in 117th AES Convention, San Francisco, CA, Oct. 28-31, 2004, Preprint 6186, pp. 1-13.

J. Herre et al., "MP3 Surround: Efficient and Compatible Coding of Multi-Channel Audio," Proceedings in 116th AES Convention, Berlin 2004, Preprint 6049, May 8-11, 2004, pp. 1-14.

J. Breebaart et al., "High-Quality Parametric Spatial Audio Coding at Low Bitrates," Proceedings in AES 116th Convention, Berlin, Preprint 6072, Ma 8-11, 2004, pp. 1-13.

E. Schuijers et al., "Low Complexity Parametric Stereo Coding," AES 116th convention, Berlin, Preprint 6073, May 8-11, 2004, pp. 1-11.

Malaysian Office Action mailed on Jun. 19, 2009 for parallel patent application No. PI20063425.

Russian Decision to grant mailed on Mar. 12, 2010 for parallel patent application No. 2008142565, 6 pages.

* cited by examiner (PRIORT ART)

| | | | | | | | | | | | |
|---|---|---|---|---|---|---|---|---|---|---|---|
| k | 0 | 1 | 2 | 3 | 4 | 5 | 6 | 7 | 8 | 9 | 10 |
| $\bar{\kappa}$ (k) | 1 | 0 | 0 | 1 | 2 | 3 | 4 | 5 | 6 | 7 | 8 |
| k | 11 | 12 | 13 | 14 | 15 | 16 | 17 | 18 | 19 | 20 | 21 |
| $\bar{\kappa}$ (k) | 9 | 10 | 11 | 12 | 13 | 14 | 14 | 15 | 15 | 15 | 16 |
| k | 22 | 23 | 24 | 25 | 26 | 27 | 28 | 29 | 30 | 31 | 32 |
| $\bar{\kappa}$ (k) | 16 | 16 | 16 | 17 | 17 | 17 | 17 | 17 | 18 | 18 | 18 |
| k | 33 | 34 | 35 | 36 | 37 | 38 | 39 | 40 | 41 | 42 | 43 |
| $\bar{\kappa}$ (k) | 18 | 18 | 18 | 18 | 18 | 18 | 18 | 18 | 18 | 19 | 19 |
| k | 44 | 45 | 46 | 47 | 48 | 49 | 50 | 51 | 52 | 53 | 54 |
| $\bar{\kappa}$ (k) | 19 | 19 | 19 | 19 | 19 | 19 | 19 | 19 | 19 | 19 | 19 |
| k | 55 | 56 | 57 | 58 | 59 | 60 | 61 | 62 | 63 | 64 | 65 |
| $\bar{\kappa}$ (k) | 19 | 19 | 19 | 19 | 19 | 19 | 19 | 19 | 19 | 19 | 19 |
| k | 66 | 67 | 68 | 69 | 70 | | | | | | |
| $\bar{\kappa}$ (k) | 19 | 19 | 19 | 19 | 19 | | | | | | |

ENHANCED METHOD FOR SIGNAL SHAPING IN MULTI-CHANNEL AUDIO RECONSTRUCTION

CROSS REFERENCES TO RELATED APPLICATIONS

This Application claims priority to U.S. patent application Ser. No. 60/787,096, filed Mar. 28, 2006, all of which is herein incorporated in its entirety by this reference thereto.

FIELD OF THE INVENTION

The present invention relates to a concept of enhanced signal shaping in multi-channel audio reconstruction and in particular to a new approach of envelope shaping.

BACKGROUND OF THE INVENTION AND PRIOR ART

Recent development in audio coding enables recreation of a multi-channel representation of an audio signal based on a stereo (or mono) signal and corresponding control data. These methods differ substantially from older matrix based solutions since additional control data is transmitted to control the recreation, also referred to as up-mix, of the surround channels based on the transmitted mono or stereo channels. Such parametric multi-channel audio decoders reconstruct N channels based on M transmitted channels, where N>M, and the additional control data. Using the additional control data causes a significantly lower data rate than transmitting all N channels, making the coding very efficient, while at the same time ensuring compatibility with both M channel devices and N channel devices. The M channels can either be a single mono channel, a stereo channel, or a 5.1 channel representation. Hence, it is possible to have an 7.2 channel original signal, downmixed to a 5.1 channel backwards compatible signal, and spatial audio parameters enabling a spatial audio decoder to reproduce a closely resembling version of the original 7.2 channels, at a small additional bit rate overhead.

These parametric surround coding methods usually comprise a parameterization of the surround signal based on time and frequency variant ILD (Inter Channel Level Difference) and ICC (Inter Channel Coherence) parameters. These parameters describe e.g. power ratios and correlations between channel pairs of the original multi-channel signal. In the decoding process, the re-created multichannel signal is obtained by distributing the energy of the received downmix channels between all the channel pairs as described by the transmitted ILD parameters. However, since a multi-channel signal can have equal power distribution between all channels, while the signals in the different channels are very different, thus giving the listening impression of a very wide sound, the correct wideness is obtained by mixing signals with decorrelated versions of the same, as described by the ICC parameter.

The decorrelated version of the signal, often also referred to as wet or diffuse signal, is obtained by passing the signal through a reverberator, such as an all-pass filter. A simple form of decorrelation is applying a specific delay to the signal. Generally, there are a lot of different reverberators known in the art, the precise implementation of the reverberator used is of minor importance.

The output from the decorrelator has a time response that is usually very flat. Hence, a dirac input signal gives a decaying noise burst out. When mixing the decorrelated and the original signal, it is for some transient signal types, like applause signals, important to perform some post-processing on the signal to avoid perceptuality of additionally introduced artefacts that may result in a larger perceived room size and pre-echo type of artefacts.

Generally, the invention relates to a system that represents multi-channel audio as a combination of audio downmix data (e.g. one or two channels) and related parametric multi-channel data. In such a scheme (for example in binaural cue coding) an audio downmix data stream is transmitted, wherein it may be noted that the simplest form of downmix is simply adding the different signals of a multi-channel signal. Such a signal (sum signal) is accompanied by a parametric multi-channel data stream (side info). The side info comprises for example one or more of the parameter types discussed above to describe the spatial interrelation of the original channels of the multi-channel signal. In a sense, the parametric multi-channel scheme acts as a pre-/post-processor to the sending/receiving end of the downmix data, e.g. having the sum signal and the side information. It shall be noted that the sum signal of the downmix data may additionally be coded using any audio or speech coder.

As transmission of multi-channel signals over low-bandwidth carriers is becoming more and more popular these systems, also known under "spatial audio coding", "MPEG surround", have been well developed recently.

The following publications are known in the context of these technologies:

[1] C. Faller and F. Baumgarte, "Efficient representation of spatial audio using perceptual parametrization," in Proc. IEEE WASPAA, Mohonk, N.Y., October. 2001.

[2] F. Baumgarte and C. Faller, "Estimation of auditory spatial cues for binaural cue coding," in Proc. ICASSP 2002, Orlando, Fla. May 2002.

[3] C. Faller and F. Baumgarte, "Binaural cue coding: a novel and efficient representation of spatial audio," in Proc. ICASSP 2002, Orlando, Fla., May 2002.

[4] F. Baumgarte and C. Faller, "Why binaural cue coding is better than intensity stereo coding," in Proc. AES 112th Conv., Munich, Germany, May 2002.

[5] C. Faller and F. Baumgarte, "Binaural cue coding applied to stereo and multi-channel audio compression," in Proc. AES 112th Conv., Munich, Germany, May 2002.

[6] F. Baumgarte and C. Faller, "Design and evaluation of binaural cue coding," in AES 113th Conv., Los Angeles, Calif., October 2002.

[7] C. Faller and F. Baumgarte, "Binaural cue coding applied to audio compression with flexible rendering," in Proc. AES 113th Conv., Los Angeles, Calif., October 2002.

[8] J. Breebaart, J. Herre, C. Faller, J. Rödbn, F. Myburg, S. Disch, H. Purnhagen, G. Hoto, M. Neusinger, K. Kjörling, W. Oomen: "MPEG Spatial Audio Coding/MPEG Surround: Overview and Current Status", 119th AES Convention, New York 2005, Preprint 6599

[9] J. Herre, H. Purnhagen, J. Breebaart, C. Faller, S. Disch, K. Kjörling, E. Schuijers, J. Hilpert, F. Myburg, "The Reference Model Architecture for MPEG Spatial Audio Coding", 118th AES Convention, Barcelona 2005, Preprint 6477

[10] J. Herre, C. Faller, S. Disch, C. Ertel, J. Hilpert, A. Hoelzer, K. Linzmeier, C. Spenger, P. Kroon: "Spatial Audio Coding: Next-Generation Efficient and Compatible Coding of Multi-Channel Audio", 117th AES Convention, San Francisco 2004, Preprint 6186

[11] J. Herre, C. Faller, C. Ertel, J. Hilpert, A Hoelzer, C. Spenger: "MP3 Surround: Efficient and Compatible Coding of Multi-Channel Audio", 116th AES Convention, Berlin 2004, Preprint 6049.

A related technique, focusing on transmission of two channels via one transmitted mono signal is called "parametric stereo" and for example described more extensively in the following publications:

[12] J. Breebaart, S. van de Par, A. Kohlrausch, E. Schuijers, "High-Quality Parametric Spatial Audio Coding at Low Bitrates", AES 116th Convention, Berlin, Preprint 6072, May 2004

[13] E. Schuijers, J. Breebaart, H. Purnhagen, J. Engdegard, "Low Complexity Parametric Stereo Coding", AES 116th Convention, Berlin, Preprint 6073, May 2004.

In a spatial audio decoder, the multi-channel upmix is computed from a direct signal part and a diffuse signal part, which is derived by means of decorrelation from the direct part, as already mentioned above. Thus, in general, the diffuse part has a different temporal envelope than the direct part. The term "temporal envelope" describes in this context the variation of the energy or amplitude of the signal with time. The differing temporal envelope leads to artifacts (pre- and post-echoes, temporal "smearing") in the upmix signals for input signals that have a wide stereo image and, at the same time, a transient envelope structure. Transient signals generally are signals that are varying strongly in a short time period.

The probably most important examples for this class of signals are applause-like signals, which are frequently present in live recordings.

In order to avoid artefacts caused by introducing diffuse/decorrelated sound with an inappropriate temporal envelope into the upmix signal, a number of techniques have been proposed:

The U.S. application Ser. No. 11/006,492 ("Diffuse Sound Shaping for BCC Schemes and The Like") shows that the perceptual quality of critical transient signals can be improved by shaping the temporal envelope of the diffuse signal to match the temporal envelope of the direct signal.

This approach has already been introduced into MPEG surround technology by different tools, such as "temporal envelope shaping" (TES) and the "temporal processing" (TP). Since the target temporal envelope of the diffuse signal is derived from the envelope of the transmitted downmix signal, this method does not require additional side information to be transmitted. However, as a consequence, the temporal fine structure of the diffuse sound is the same for all output channels. As the direct signal part, which is directly derived from the transmitted downmix signal, does also have a similar temporal envelope, this method may improve the perceptual quality of applause-like signals in terms of "crispness", i.e. However, as then the direct signal and diffuse signal have similar temporal envelopes for all channels, such techniques may enhance the subjective quality of applause-like signals but cannot improve the spatial distribution of single applause events in the signal, as this would only be possible, when one reconstructed channel would be much more intense at the occurrence of the transient signal than the other channels, which is impossible having signals sharing basically the same temporal envelope.

An alternative method to overcome the problem is described by U.S. application Ser. No. 11/006,482 ("individual Channel Shaping for BCC Schemes and The Like"). This approach employs fine-grain temporal broad band side information that is transmitted by the encoder to perform a fine temporal shaping of both the direct and the diffuse signal. Evidently, this approach allows a temporal fine structure that is individual for each output channel and thus is able to accommodate also signals for which transient events occur in only a subset of the output channels. A further variation of this approach is described in U.S. 60/726,389 ("Methods for Improved Temporal and Spatial Shaping of Multi-Channel Audio Signals"). Both discussed approaches to enhance perceptual quality of transient coded signals comprise a temporal shaping of the envelope of the diffuse signal intended to match a corresponding direct signals temporal envelope.

While both previously described prior-art methods can enhance the subjective quality of applause-like signals in terms of crisp-ness, only the latter approach can also improve the spatial redistribution of the reconstructed signal. Still, the subjective quality of the synthesized applause signals remains unsatisfactory, because the temporal shaping of both the combination of dry and diffused sound leads to characteristic distortions (the attacks of the individual claps are either perceived as not "tight" when only a loose temporal shaping is performed, or distortions are introduced if shaping with a very high temporal resolution is applied to the signal). This becomes evident, when a diffuse signal is simply a delayed copy of the direct signal. Then, the diffused signal mixed to the direct signal is likely to have a different spectral composition than the direct signal. Thus, even if the envelope is scaled to match the envelope of the direct signal, different spectral contributions, not originating directly from the original signal will be present in the reconstructed signal. The introduced distortions may become even worse, when the diffuse signal part is emphasized (made louder) during the reconstruction, when the diffuse signal is scaled to match the envelope of the direct signal.

SUMMARY OF THE INVENTION

It is the object of the present invention to provide a concept of enhanced signal shaping in multi-channel reconstruction.

In accordance with a first aspect of the present invention this object is achieved by a multi-channel reconstructor for generating a reconstructed output channel using at least one downmix channel derived by downmixing a plurality of original channels and using a parameter representation, the parameter representation including information on a temporal structure of an original channel, comprising: a generator for generating a direct signal component and a diffuse signal component for the reconstructed output channel, based on the downmix channel; a direct signal modifier for modifying the direct signal component using the parameter representation; and a combiner for combining the modified direct signal component and the diffuse signal component to obtain the reconstructed output channel.

In accordance with a second aspect of the present invention this object is achieved by a method for generating a reconstructed output channel using at least one downmix channel derived by downmixing a plurality of original channels and using a parameter representation, the parameter representation including information on a temporal structure of an original channel, the method comprising: generating a direct signal component and a diffuse signal component for the reconstructed output channel, based on the downmix channel; modifying the direct signal component using the parameter representation; and combining the modified direct signal component and the diffuse signal component to obtain the reconstructed output channel.

In accordance with a third aspect of the present invention this object is achieved by Multi-channel audio decoder for generating a reconstruction of a multi-channel signal using at least one downmix channel derived by downmixing a plurality of original channels and using a parameter representation, the parameter representation including information on a temporal structure of an original channel, the multi-channel audio decoder, comprising a multi-channel reconstructor.

In accordance with a fourth aspect of the present invention this object is achieved by a computer program with a program code for running the method for generating a reconstructed output channel using at least one downmix channel derived by downmixing a plurality of original channels and using a parameter representation, the parameter representation including information on a temporal structure of an original channel, the method comprising: generating a direct signal component and a diffuse signal component for the reconstructed output channel, based on the downmix channel; modifying the direct signal component using the parameter representation; and combining the modified direct signal component and the diffuse signal component to obtain the reconstructed output channel.

The present invention is based on the finding that a reconstructed output channel, reconstructed with a multi-channel reconstructor using at least one downmix channel derived by downmixing a plurality of original channels and using a parameter representation including additional information on a temporal (fine) structure of an original channel can be reconstructed efficiently with high quality, when a generator for generating a direct signal component and a diffuse signal component based on the downmix channel is used. The quality can be essentially enhanced, if only the direct signal component is modified such that the temporal fine structure of the reconstructed output channel is fitting a desired temporal fine structure, indicated by the additional information on the temporal fine structure transmitted.

In other words, scaling the direct signal parts directly derived from the downmix signal, hardly introduces additional artifacts at the moment a transient signal occurs. When, as in prior art, the wet signal part is scaled to match a desired envelope, it may very well be the case that the original transient signal in the reconstructed channel is masked by an emphasized diffuse signal mixed to the direct signal, which will be more extensively described below.

The present invention overcomes this problem by only scaling the direct signal component, thus giving no opportunity to introduce additional artifacts at the cost of transmitting additional parameters to describe the temporal envelope within the side information.

According to one embodiment of the present invention, envelope scaling parameters are derived using a representation of the direct and the diffuse signal with a whitened spectrum, i.e., where different spectral parts of the signal have almost identical energies. The advantages of using whitened spectra are twofold. One the one hand, using a whitened spectrum as a basis for the calculation of a scaling factor used to scale the direct signal allows for the transmission of only one parameter per time slot including information on the temporal structure. As it is usual in multi-channel audio coding that signals are processed within numerous frequency bands, this feature helps to decrease the number of additionally needed side information and hence the bit rate increase for the transmission of the additional parameter. Typically, other parameters such as ICLD and ICC are transmitted once per time frame and parameter band. As the number of parameter bands may be higher than 20, it is a major advantage having to transmit only one single parameter per channel. Generally, in multi-channel coding, signals are processed in a frame structure, i.e., in entities having several sampling values, for example 1024 per frame. Furthermore, as already mentioned, the signals are split into several spectral portions before being processed, such that finally typically one ICC and ICLD parameter is transmitted per frame and spectral portion of the signal.

The second advantage of using only one parameter is physically motivated, since the transient signals in question naturally have broad spectra. Therefore, to account for the energy of the transient signals within the single channels correctly, it is most appropriate to use whitened spectra for the calculation of energy scaling factors.

In a further embodiment of the present invention the inventive concept of modifying the direct signal component is only applied for a spectral portion of the signal above a certain spectral limit in the presence of additional residual signals. This is because residual signals together with the downmix signal allow for a high quality reproduction of the original channels.

Summarizing, the inventive concept is designed to provide enhanced temporal and spatial quality with respect to the prior art approaches, avoiding the problems associated with those techniques. Therefore, side information is transmitted to describe the fine time envelope structure of the individual channels and thus allow fine temporal/spatial shaping of the upmix channel signals at the decoder side. The inventive method described in this document is based on the following findings/considerations:

- Applause-like signals can be seen as composed of single, distinct nearby claps and a noise-like ambience originating from very dense far-off claps.
- In a spatial audio decoder, the best approximation of the nearby claps in terms of temporal envelope is the direct signal. Therefore, only the direct signal is processed by the inventive method.
- Since the diffuse signal represents mainly the ambience part of the signal, any processing on a fine temporal resolution is likely to introduce distortion and modulation artefacts (even though a certain subjective enhancement of applause 'crispness' might be achieved by such a technique). As a consequence to these considerations, thus the diffuse signal is untouched (i.e. not subjected to a fine time shaping) by the inventive processing.
- Nevertheless the diffuse signal contributes to the energy balance of the upmixed signal. The inventive method accounts for this by calculating a modified broadband scaling factor from the transmitted information that is to be applied solely to the direct signal part. This modified factor is chosen such that the overall energy in a given time interval is the same within certain bounds as if the original factor had been applied to both the direct and the diffuse part of the signal in this interval.
- Using the inventive method, best subjective audio quality is obtained if the spectral resolution of the spatial cues is chosen to be low—for instance 'full bandwidth'—to ensure preservation of spectral integrity of the transients contained in the signal.

In this case, the proposed method does not necessarily increase the average spatial side information bitrate, since spectral resolution is safely traded for temporal resolution.

The subjective quality improvement is achieved by amplifying or damping ("shaping") the dry part of the signal over time only and thus

- Enhancing transient quality by strengthening the direct signal part at the transient location, while avoiding additional distortion originating from a diffuse signal with inappropriate temporal envelope
- Improving spatial localisation by emphasizing the direct part w.r.t. the diffuse part at the spatial origin of a transient event and damping it relative to the diffuse part at far-off panning positions.

DETAILED DESCRIPTION OF THE FURTHER EMBODIMENTS

Figure 1:
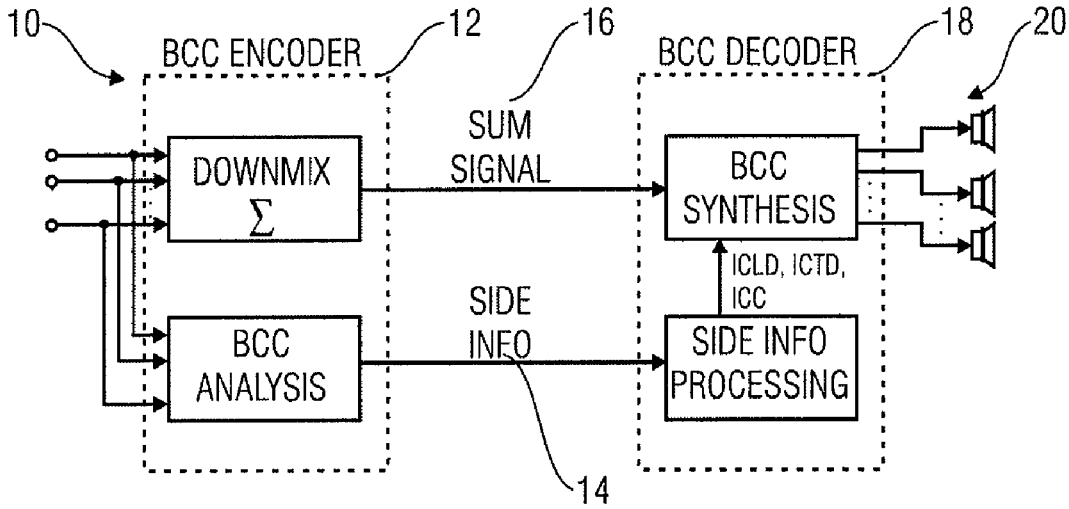
FIG. 1 shows a block diagram of a multi-channel encoder and a corresponding decoder.

FIG. 1 shows an example for coding of multi-channel audio data according to prior art, to more clearly illustrate the problem solved by the inventive concept.

Generally, on an encoder side, an original multi-channel signal 10 is input into the multi-channel encoder 12, deriving side information 14 indicating the spatial distribution of the various channels of the original multi-channel signals with respect to one another. Apart from the generation of side information 14, a multi-channel encoder 12 generates one or more sum signals 16, being downmixed from the original multi-channel signal. Famous configurations widely used are so-called 5-1-5 and 5-2-5 configurations. In 5-1-5 configuration the encoder generates one single monophonic sum signal 16 from five input channels and hence, a corresponding decoder 18 has to generate five reconstructed channels of a reconstructed multi-channel signal 20. In the 5-2-5 configuration, the encoder generates two downmix channels from five input channels, the first channel of the downmixed channels typically holding information on a left side or a right side and the second channel of the downmixed channels holding information on the other side.

Sample parameters describing the spatial distribution of the original channels are, as for example indicated in FIG. 1, the previously introduced parameters ICLD and ICC.

It may be noted that within the analysis deriving the side information 14, the samples of the original channels of the multi-channel signal 10 are typically processed in subband domains representing a specific frequency interval of the original channels. A single frequency interval is indicated by K. In some applications, the input channels may be filtered by a hybrid filter bank before the processing, i.e., the parameter bands K may be further subdivided, each subdivision denoted with k; see for example in FIG. 4.

Furthermore, the processing of the sample values describing an original channel, is done in a frame-wise manner within each single parameter band, i.e. several consecutive samples form a frame of finite duration. The BCC parameters mentioned above typically describe a full frame.

A parameter in some way related to the present invention and already known in the art is the ICLD parameter, describing the energy contained within a signal frame of a channel with respect to the corresponding frames of other channels of the original multi-channel or signal.

Commonly, the generation of additional channels to derive a reconstruction of a multi-channel signal from one transmitted sum signal only is achieved with the help of decorrelated signals, being derived from the sum signal using decorrelators or reverberators. For a typical application, the discrete sample frequency may be 44.100 kH, such that a single sample represents an interval of finite length of about 0.02 ms of an original channel. It may be noted that, using filter banks, the signal is split into numerous signal parts, each representing a finite frequency interval of the original signal. To compensate for a possible increase in parameters describing the channel, the time resolution is normally decreased, such that a finite length time portion described by a single sample within a filter bank domain may increase to more than 0.5 ms. Typical frame length may vary between 10 and 15 ms.

Deriving the decorrelated signal may make use of different filter structures and/or delays or combinations thereof without limiting the scope of the invention. It may be furthermore noted that not necessarily the whole spectrum has to be used to derive the decorrelated signals. For example, only spectral portions above a spectral lower bound (specific value of K) of the sum signal (downmix signal) may be used to derive the decorrelated signals using delays and/or filters. A decorrelated signal thus generally describes a signal derived from the downmix signal (downmix channel) such that a correlation coefficient, when derived using the decorrelated signal and the downmix channel significantly deviates from unity, for example by 0.2.

Figure 1B:
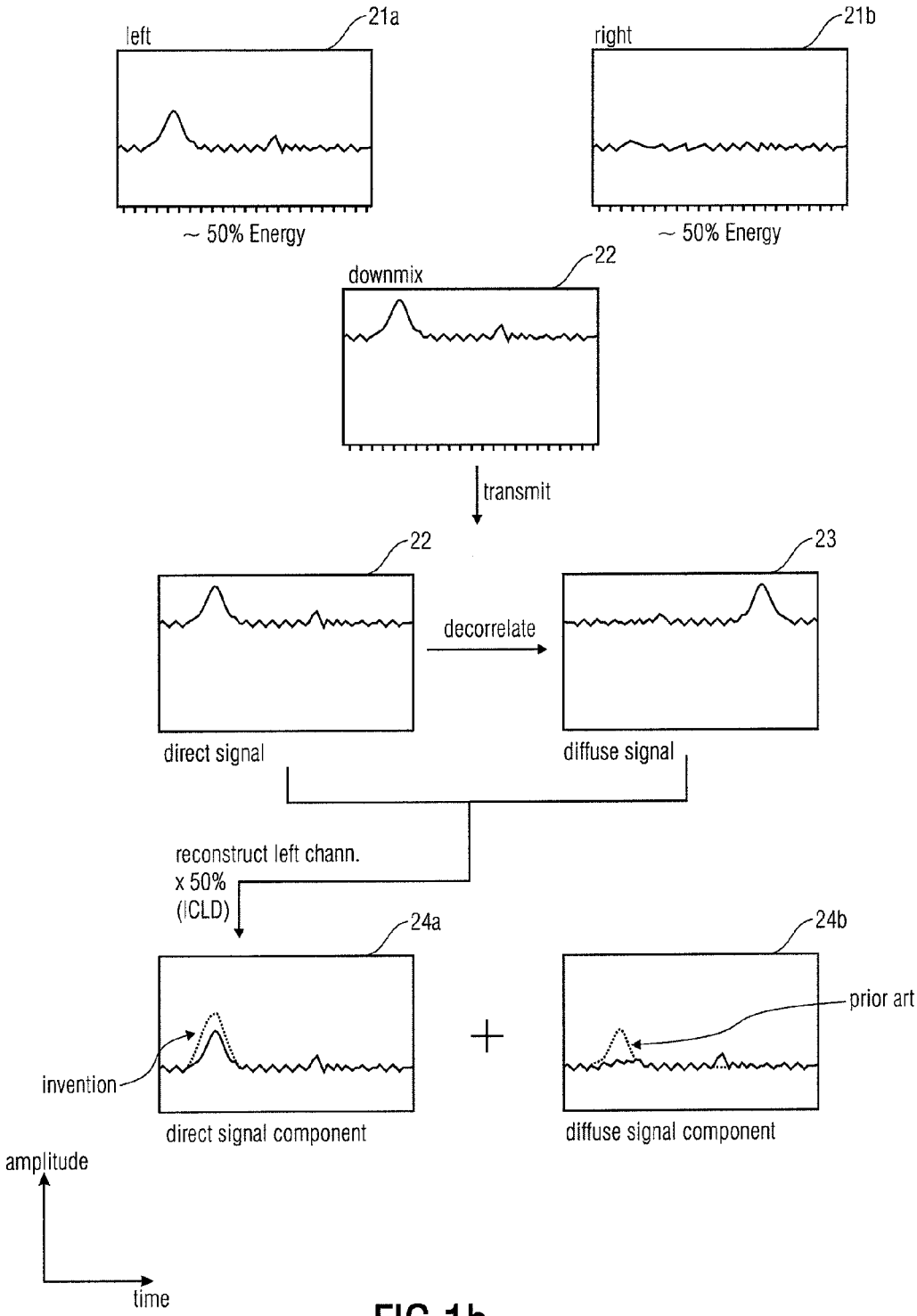
FIG. 1*b* shows a schematic sketch of signal reconstruction using decorrelated signals.

FIG. 1*b* gives an extremely simplified example of the downmix and reconstruction process during multi-channel audio coding to explain the great benefit of the inventive concept of scaling only the direct signal component during reconstruction of a channel of a multi-channel signal. For the following description, some simplifications are assumed. The first simplification is that the down-mix of a left and a right channel is a simple addition of the amplitudes within the channels. The second strong simplification is, that the correlation is assumed to be a simple delay of the whole signal.

Under these assumptions, a frame of a left channel 21*a* and a right channel 21*b* shall be encoded. As indicated on the x-axis of the shown windows, in multi-channel audio coding, the processing is typically performed on sample values, sampled with a fixed sample frequency. This shall, for ease of explanation, be furthermore neglected in the following short summary.

As already mentioned, on the encoder side, a left and right channel is combined (down-mixed) into a down-mix channel 22 that is to be transmitted to the decoder. On the decoder side, a decorrelated signal 23 is derived from the transmitted down-mix channel 22, which is the sum of the left channel 21*a* and the right channel 21*b* in this example. As already explained, the reconstruction of the left channel is then performed from signal frames derived from the down-mix channel 22 and the decorrelated signal 23.

It may be noted that each single frame is undergoing a global scaling before the combination, as indicated by the ICLD parameter, which relates the energies within the individual frames of single channels to the energy of the corresponding frames of the other channels of a multi-channel signal.

As it is assumed in the present example, that equal energies are contained within the frame of the left channel 21*a* and the frame of the right channel 21*b*, the transmitted down-mix channel 22 and the decorrelated signal 23 are scaled by roughly the factor of 0.5 before the combination. That is, when up-mixing is equally simple as down-mixing, i.e. summing up the two signals, the reconstruction of the original left channel 21*a* is the sum of the scaled down-mix channel 24*a* and the scaled decorrelated signal 24*b*.

Because of the summation for transmission and the scaling due to the ICLD parameter, the signal to background ratio of the transient signal would be decreased by a factor of roughly 2. Furthermore, when simply adding the two signals, an additional echo type of artefact would be introduced at the position of the delayed transient structure in the scaled decorrelated signal 24*b*.

As indicated in FIG. 1*b*, prior art tries to overcome the echo problem by scaling the amplitude of the scaled decorrelated signal 24*b* to make it match the envelope of the scaled transmitted channel 24*a*, as indicated by the dashed lines in frame 24*b*. Due to the scaling, the amplitude at the position of the original transient signal in the left channel 21*a* may be increased. However, the spectral composition of the decorrelated signal at the position of the scaling in frame 24*b* is different from the spectral composition of the original transient signal. Therefore, audible artefacts are introduced into the signal, even though the general intensity of the signal may be reproduced well.

The great advantage of the present invention is that the present invention does only scale a direct signal component of reconstructed. As this channel does have a signal component corresponding to the original transient signal having the right spectral composition and the right timing, scaling only the down-mix channel will yield a reconstructed signal reconstructing the original transient event with high accuracy. This is the case since only signal parts are emphasized by the scaling that have the same spectral composition as the original transient signal.

Figure 2:
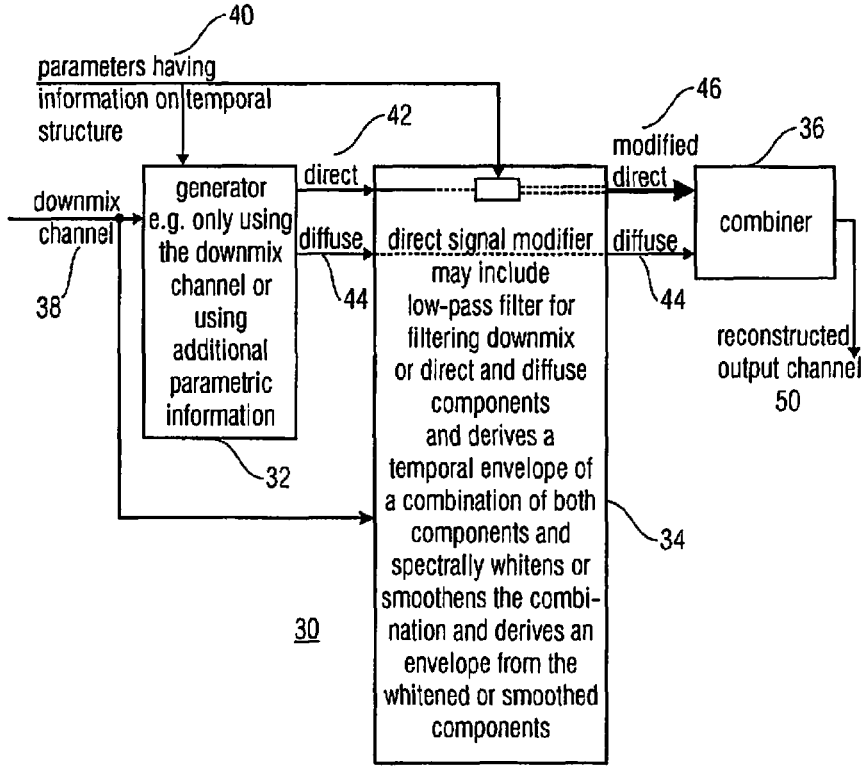
FIG. 2 shows an example for an inventive multi-channel reconstructor.

FIG. 2 shows a block diagram of a example of an inventive multi-channel reconstructor, to detail the principal of the inventive concept.

FIG. 2 shows a multi-channel reconstructor 30, having a generator 32, a direct signal modifier and a combiner 36. The generator 32 receives a downmix channel 38 downmixed from a plurality of original channels and a parameter representation 40 including information on a temporal structure of an original channel.

The generator generates a direct signal component 42 and a diffuse signal component 44 based on the downmix channel. In an embodiment, the generator is operated to generate the direct signal component using only components of the downmix channel.

The direct signal modifier 34 receives as well the direct signal component 42 as the diffuse signal component 44 and in addition the parameter representation 40 having the information on a temporal structure of the original channel. According to the present invention, the direct signal modifier modifies only the direct signal component 42 using the parameter representation to derive a modified direct signal component 46. In an embodiment, the direct signal modifier is operative to use information on the temporary structure of the original channel indicating a mean amplitude of the original channel within a finite length time portion of the original channel. In an embodiment, the direct signal modifier is further operative to derive a target temporal envelope for the reconstructed downmix channel using the downmix temporal envelope and therein the direct signal modifier is further operative for scaling the downmix temporal envelope with encoded transmitted and re-quantized envelope ratios. Furthermore, the direct signal modifier may be operative to derive the downmix temporal envelope for a spectral portion of the downmix channel only for subbands above a spectral lower boundary presented by a subband index. In an embodiment, the direct signal modifier is operative to derive a smooth representation by filtering the direct signal component and the diffuse signal component with a first order lowpass filter.

The modified direct signal component 46 and the diffuse signal component 44, which is not altered by the direct signal modifier 34, are input into the combiner 36 that combines the modified direct signal component 46 and the diffuse signal component 44 to obtain a reconstructed output channel 50.

By only modifying the direct signal component 42 derived from the transmitted downmix channel 38 without reverberation (decorrelation), it is possible to reconstruct a time envelope for the reconstructed output channel matching closely a time envelope of the underlying original channel without introducing additional artefacts and audible distortions, as in prior art techniques. In an embodiment, the multi-channel reconstructor is operative to use a first downmix channel having information on a left side of the plurality of original channels and a second downmix channel having information on a right side of the plurality of original channels, wherein a first reconstructed output channel for a left side is combined using only direct and diffuse signal components generated from the first downmix channel and wherein a second reconstructed output channel for a right side is combined using direct and diffuse signal components generated only from the second downmix signal.

As will be discussed in more detail in the description of FIG. 3, the inventive envelope shaping restores the broad band envelope of the synthesized output signal. It comprises a modified upmix procedure, followed by envelope flattening and reshaping of the direct signal portion of each output channel. For reshaping, parametric broad band envelope side information contained in the bit stream of the parameter representation is used. This side information consists, according to one embodiment of the present invention, of ratios (envRatio) relating the transmitted downmix signal's envelope to the original input channel signal's envelope. In the decoder, gain factors are derived from these ratios to be applied to the direct signal on each time slot in a frame of a given output channel. The diffuse sound portion of each channel is not altered according to the inventive concept.

Figure 3:
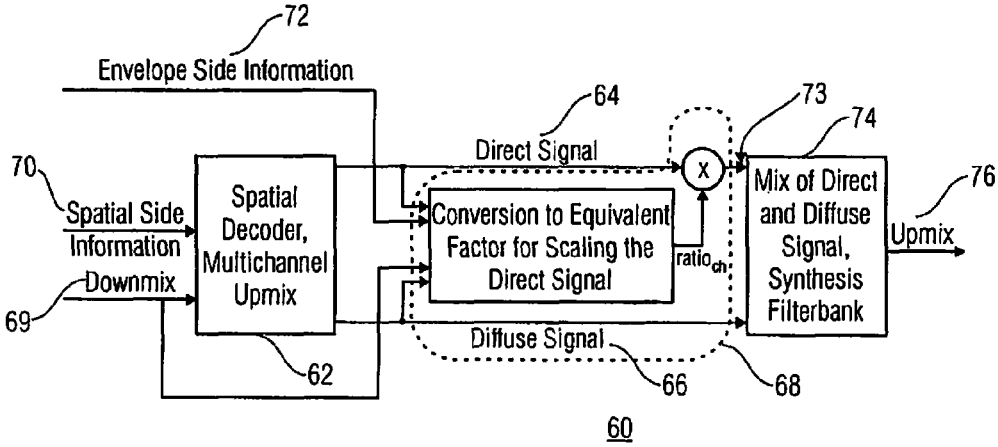
FIG. 3 shows a further example for an inventive multi-channel reconstructor.

The preferred embodiment of the present invention shown in the block diagram of FIG. 3 is a multi-channel reconstructor 60 modified to fit in the decoder signal flow of a MPEG spatial decoder.

The multi-channel reconstructor 60 comprises a generator 62 for generating a direct signal component 64 and a diffuse signal component 66 using a downmix channel 68 derived by downmixing a plurality of original channels and a parameter representation 70 having information on spatial properties of original channels of the multi-channel signal, as used within MPEG coding. The multi-channel reconstructor 60 further comprises a direct signal modifier 69, receiving the direct signal component 64, the diffuse signal component 66, the downmix signal 68 and additional envelope side information 72 as input.

The direct signal modifier provides at its modifier output 73 the modified direct signal component, modified as described in more detail below.

The combiner 74 receives the modified direct signal component and the diffuse signal component to obtain the reconstructed output channel 76.

As shown in the Figure, the present invention may be easily implemented in already existing multi-channel environments. General application of the inventive concept within such a coding scheme could be switched on and off according to some parameters additionally transmitted within the parameter bit stream. For example, an additional flag bsTempShapeEnable could be introduced, which indicates, when set to 1, usage of the inventive concept is required.

Furthermore, an additional flag could be introduced, specifying specifically the need of the application of the inventive concept on a channel by channel basis. Therefore, an additional flag may be used, called for example bsEnvShapeChannel. This flag, available for each individual channel, may then indicate the use of the inventive concept, when set to 1.

It may furthermore be noted that for ease of presentation, only a two channel configuration is described in FIG. 3. Of course, the present invention is not intended to be limited to a two channel configuration only. Moreover, any channel configuration may be used in connection with the inventive concept. For example, five or seven input channels may be used in connection with the inventive advanced envelope shaping.

When the inventive concept is applied within an MPEG coding scheme, as indicated in FIG. 3, and the application of the inventive concept is signaled by setting bsTempShapeEnable equal to 1, direct and diffuse signal components are synthesized separately by generator 62 using a modified postmixing in the hybrid subband domain according to the following formula:

$$y_{direct}^{n,k}=M^{n,k}w_{direct}^{n,k}0\leq k<K$$

$$y_{diffuse}^{n,k}=M^{n,k}w_{diffuse}^{n,k}0\leq k<K$$

Here and in the following paragraphs, vector $w_{m,k}$ describes the vector of n hybrid subband parameters for the k'th subband of the subband domain. As indicated by the above equation, direct and diffuse signal parameters y are separately derived in the upmixing. The direct outputs hold the direct signal component and the residual signal, which is a signal that may be additionally present in MPEG coding. Diffuse outputs provide the diffuse signal only. According to the inventive concept, only the direct signal component is further processed by the guided envelope shaping (the inventive envelope shaping).

The envelope shaping process employs an envelope extraction operation on different signals. The envelopes extraction process taking place within direct signal modifier 69 is described in further detail in the following paragraphs as this is a mandatory step before application of the inventive modification to the direct signal component.

As already mentioned, within the hybrid subband domain, subbands are denoted k. Several subbands k may also be organized in parameter bands κ.

The association of subbands to parameter bands underlying the embodiment of the present invention discussed below, is given in the tabular of FIG. 4.

First, for each slot in a frame, the energies $E_{slot}^{\kappa}$ of certain parameter bands κ are calculated with $y^{n,\tilde{k}}$ being a hybrid subband input signal.

$$E_{slot}^{\kappa}(n)=\sum_{\tilde{k}} y^{n,\tilde{k}}\left(y^{n,\tilde{k}}\right)^{*}\quad \tilde{k}=\{k\mid \bar{\kappa}(k)=\kappa\}\forall\ \kappa_{start}<\kappa<\kappa_{stop}$$

with $\kappa_{start}=10$ and $\kappa_{stop}=18$

The summation includes all $\tilde{k}$ being attributed to one parameter band K according to Table A.1.

Subsequently, a long-term energy average $\overline{E}_{slot}^{\kappa}$ for each parameter band is calculated as $$\overline{E}_{slot}^{\kappa}(n)=(1-\alpha)E_{slot}^{\kappa}(n)+\alpha\overline{E}_{slot}^{\kappa}(n-1)$$

$$\alpha=\exp\left(-\frac{64}{0.4\cdot 44100}\right)$$

With α being a weighting factor corresponding to a first order IIR lowpass (approx. 400 ms time constant) and n is denoting the time slot index. The smoothed total average (broadband) energy $\overline{E}_{total}$ is calculated to be $$\overline{E}_{total}(n)=(1-\alpha)E_{total}(n)+\alpha\overline{E}_{total}(n-1)$$

with $$E_{total}(n)=\frac{1}{\kappa_{stop}-\kappa_{start}+1}\sum_{\kappa=\kappa_{start}}^{\kappa_{stop}}E_{slot}^{\kappa}(n)$$

$$\alpha=\exp\left(-\frac{64}{0.4\cdot 44100}\right)$$

As can be seen from the above formulas, the temporal envelope is smoothed before the gain factors are derived from the smoothed representation of the channels. Smoothing generally means deriving a smoothed representation from an original channel having decreased gradients.

As can be seen from the above formulas, the subsequently described whitening operation is based on temporally smoothed total energy estimates and smoothed energy estimates in the subbands, thus ensuring greater stability of the final envelope estimates.

The ratio of these energies is determined to obtain weights for a spectral whitening operation:

$$w^{\kappa}(n)=\frac{\overline{E}_{total}(n)}{\overline{E}_{slot}^{\kappa}(n)+\varepsilon}$$

The broadband envelope estimate is obtained by summation of the weighted contributions of the parameter bands, normalizing on a long-term energy average and calculation of the square root $$Env(n)=\sqrt{\frac{EnvAbs(n)}{\overline{Env}(n)}}$$

with $$EnvAbs(n)=\sum_{\kappa=\kappa_{start}}^{\kappa_{stop}}w^{\kappa}(n)\cdot E_{slot}^{\kappa}(n)$$

$$\overline{Env}(n)=(1-\beta)EnvAbs(n)+\beta\overline{Env}(n-1)$$

$$\beta=\exp\left(-\frac{64}{0.04\cdot 44100}\right)$$

β is a weighting factor corresponding to a first order IIR lowpass (approx. 40 ms time constant).

Spectrally whitened energy or amplitude measures are used as the basis for the calculation of the scaling factors. As can be seen from the above formulas, spectrally whitening means altering the spectrum such, that the same energy or mean amplitude is contained within each spectral band of the representation of the audio channels. This is most advantageous since the transient signals in question have very broad spectra such that it is necessary to use full information on the whole available spectrum for the calculation of the gain factors to not suppress the transient signals with respect to other non-transient signals. In other words, spectrally whitened signals are signals that have approximately equal energy in different spectral bands of their spectral representation.

The inventive direct signal modifier modifies the direct signal component. As already mentioned, processing may be restricted to some subband indices starting with a starting index, in the presence of transmitted residual signals. Furthermore, processing may generally be restricted to subband indices above a threshold index.

The envelope shaping process consists of a flattening of the direct sound envelope for each output channel followed by a reshaping towards a target envelope. This results in a gain curve being applied to the direct signal of each output channel if bsEnvShapeChannel=1 is signalled for this channel in the side information.

The processing is done for certain hybrid sub-subbands k only:

$$k>7$$

In presence of transmitted residual signals, k is chosen to start above the highest residual band involved in the upmix of the channel in question.

For 5-1-5 configuration the target envelope is obtained by estimating the envelope of the transmitted downmix $Env_{Dmx}$, as described in the previous section, and subsequently scaling it with encoder transmitted and re-quantized envelope ratios $envRatio_{ch}$.

Then, a gain curve $g_{ch}(n)$ for all slots in a frame is calculated for each output channel by estimating its envelope $Env_{ch}$ and relate it to the target envelope. Finally, this gain curve is converted into an effective gain curve for solely scaling the direct part of the upmixed channel:

$$ratio_{ch}(n)=\min(4,\max(0.25,g_{ch}+ampRatio_{ch}(n)\cdot(g_{ch}-1)))$$

with $$g_{ch}(n)=\frac{envRatio_{ch}(n)\cdot Env_{Dmx}(n)}{Env_{ch}(n)}$$

$$ampRatio_{ch}(n)=\frac{\sum_k |y_{ch,diffuse}^{n,k}|}{\sum_k |y_{ch,direct}^{n,k}|+\varepsilon}$$

$$ch\in\{L,\ Ls,\ C,\ R,\ Rs\}$$

For 5-2-5 configuration the target envelope for L and Ls is derived from the left channel transmitted downmix signal's envelope $Env_{DmxL}$, for R and Rs the right channel transmitted downmix envelope is used $Env_{DmxR}$. The center channel is derived from the sum of left and right transmitted downmix signal's envelopes.

The gain curve is calculated for each output channel by estimating its envelope $Env^{L,Ls,C,R,Rs}$ and relate it to the target envelope. In a second step this gain curve is converted into an effective gain curve for solely scaling the direct part of the upmixed channel:

$$ratio_{ch}(n)=\min(4,\max(0.25,g_{ch}+ampRatio_{ch}(n)\cdot(g_{ch}-1)))$$

with $$ampRatio_{ch}(n)=\frac{\sum_k |y_{ch,diffuse}^{n,k}|}{\sum_k |y_{ch,direct}^{n,k}|+\varepsilon},\ ch\in\{L,\ Ls,\ C,\ R,\ Rs\}$$

$$g_{ch}(n)=\frac{envRatio_{ch}(n)\cdot Env_{DmxL}(n)}{Env_{ch}(n)},\ ch\in\{L,\ Ls\}$$

-continued $$g_{ch}(n)=\frac{envRatio_{ch}(n)\cdot Env_{DmxR}(n)}{Env_{ch}(n)},\ ch\in\{R,\ Rs\}$$

$$g_{ch}(n)=\frac{envRatio_{ch}(n)\cdot 0.5(Env_{DmxL}(n)+Env_{DmxR}(n))}{Env_{ch}(n)},$$

$$ch\in\{C\}$$

For all channels, the envelope adjustment gain curve is applied if bsEnvShapeChannel=1.

$$\bar{y}_{ch,direct}^{k}(n)=ratio_{ch}(n)\cdot y_{ch,direct}^{k}(n),\ ch\in\{L,Ls,C,R,Rs\}$$

Else the direct signal is simply copied $$\tilde{y}_{ch,direct}^{k}(n)=y_{ch,direct}^{k}(n),\ ch\in\{L,Ls,C,R,Rs\}$$

Finally, the modified direct signal component of each individual channel has to be combined with the diffuse signal component of the corresponding individual channel within the hybrid subband domain according to the following equation:

$$y_{ch}^{n,k}=\tilde{y}_{ch,direct}^{n,k}+y_{ch,diffuse}^{n,k},\ ch\in\{L,Ls,C,R,Rs\}$$

As can be seen from the above paragraphs, the inventive concept teaches improving the perceptual quality and spatial distribution of applause-like signals in a spatial audio decoder. The enhancement is accomplished by deriving gain factors with fine scale temporal granularity to scale the direct part of the spatial upmix signal only. These gain factors are derived essentially from transmitted side information and level or energy measurements of the direct and diffuse signal in the encoder.

As the above example particularly describes the calculation based on amplitude measurements, it should be noted that the inventive method is not restricted to this but could also calculate with, for example energy measurements or other quantities suitable to describe a temporal envelope of a signal.

The above example describes the calculation for 5-1-5 and 5-2-5 channel configurations. Naturally, the above outlined principle could be applied analogously for e.g. 7-2-7 and 7-5-7 channel configurations.

In an embodiment, the direct signal modifier is operative to use the information on a temporal structure of the original channel that is relating to the temporal structure of the original channel to a temporal structure of the downmix channel.

In an embodiment, the information on the temporal structure of the original channel and the information on the temporal structure of the downmix channel is having an energy or an amplitude measure.

In an embodiment, the direct signal modifier is further operative to derive downmix temporal information on the temporal structure of the downmix channel.

In an embodiment, the direct signal modifier is further operative to derive a target temporal structure for the reconstructed downmix channel using the downmix temporal information and the information on the temporal structure of the original channel.

In an embodiment, the direct signal modifier is operative to derive a target temporal structure for the reconstructed output channel using the downmix channel and the information on the temporal structure.

In an embodiment, the direct signal modifier is operative to modify the direct signal component such that a temporal structure of the reconstructed output channel equals the target temporal structure within a tolerance range.

In an embodiment, the direct signal modifier is operative to derive an intermediate scaling factor, the intermediate scaling factor being such that the temporal structure of the reconstructed output channel equals the target temporal structure within the tolerance range, when the reconstructed output channel is combined using the direct signal components scaled with the intermediate scaling factor and the diffuse signal component scaled with the intermediate scaling factor.

In an embodiment, the direct signal modifier is further operative to derive a final scaling factor using the intermediate scaling factor and the direct and diffuse signal components such that the temporal structure of the reconstructed output channel equals the target temporal structure within the tolerance range, when the reconstructed output channel is combined using the diffuse signal component and the direct signal component scaled using the final scaling factor.

In an embodiment, the direct signal modifier is further operative to derive information on a temporal structure of a combination of the direct signal component and the diffuse signal component.

In an embodiment, the direct signal modifier is operative to spectrally whiten the combination of the direct signal and the diffuse signal components and to derive the information on the temporal structure of the combination of the direct signal and the diffuse signal components using the spectrally whitened direct and diffuse signal components.

In an embodiment, the direct signal modifier is further operative to derive a smoothed representation of the combination of the direct and the diffuse signal components and to derive the information on the temporal structure of the combination of the direct and the diffuse signal components from the smoothed representation of the combination of the direct and the diffuse signal components.

In an embodiment, the direct signal modifier is operative to derive the smoothed representation by filtering the direct and the diffuse signal components with a first order lowpass filter.

In an embodiment, the direct signal modifier is operative to derive the downmix temporal information for a spectral portion of the downmix channel above a spectral lower bound.

In an embodiment, the direct signal modifier is further operative to spectrally whiten the downmix channel and to derive the downmix temporal information using the spectrally whitened downmix channel.

In an embodiment, the direct signal modifier is further operative to derive a smoothed representation of the downmix channel and to derive the downmix temporal information from the smoothed representation of the downmix channel.

In an embodiment, the direct signal modifier is operative to derive the smoothed representation by filtering the downmix channel with a first order lowpass filter.

Figures 4, 5:
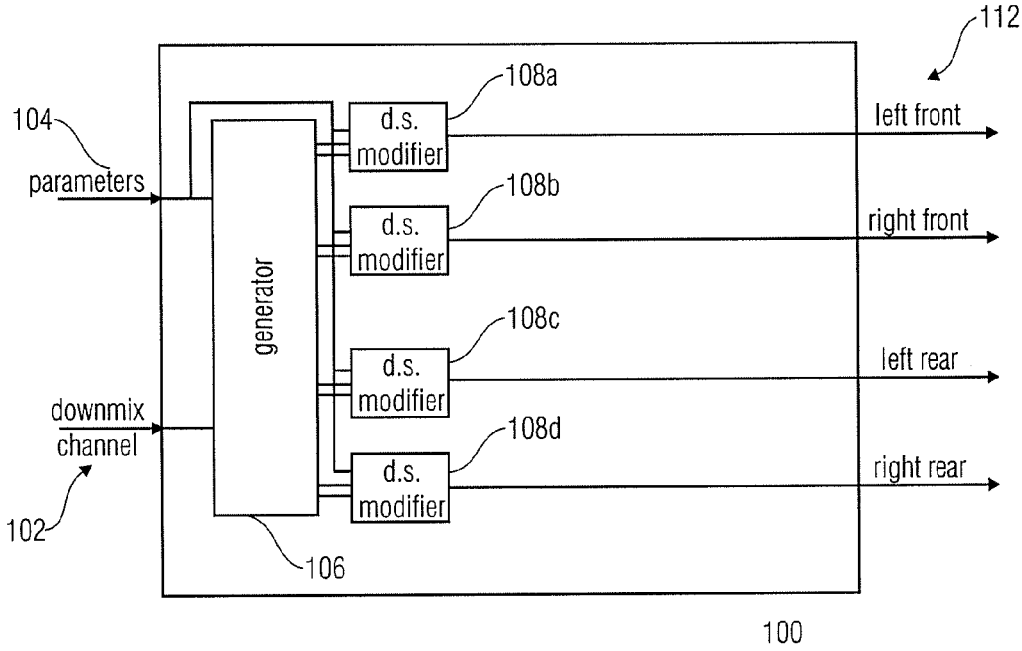
FIG. 4 shows an example for parameter band representations used to identify different parameter bands within a multi-channel decoding scheme.
FIG. 5 shows an example for an inventive multi-channel decoder.

FIG. 5 shows an example of an inventive multi-channel audio decoder 100, receiving a downmix channel 102 derived by downmixing a plurality of channels of one original multi-channel signal and a parameter representation 104 including information on a temporal structure of the original channels (left front, right front, left rear and right rear) of the original multi-channel signal. The multi-channel decoder 100 is having a generator 106 for generating a direct signal component and a diffuse signal component for each of the original channels underlying the downmix channel 102. The multi-channel decoder 100 further comprises four inventive direct signal modifiers 108*a* to 108*d* for each of the channels to be reconstructed, such that the multi-channel decoder outputs four output channels (left front, right front, left rear and right rear) on its outputs 112.

Although the inventive multi-channel decoder has been detailed using an example configuration of four original channels to be reconstructed, the inventive concept may be implemented in multi-channel audio schemes having arbitrary numbers of channels.

Figure 6:
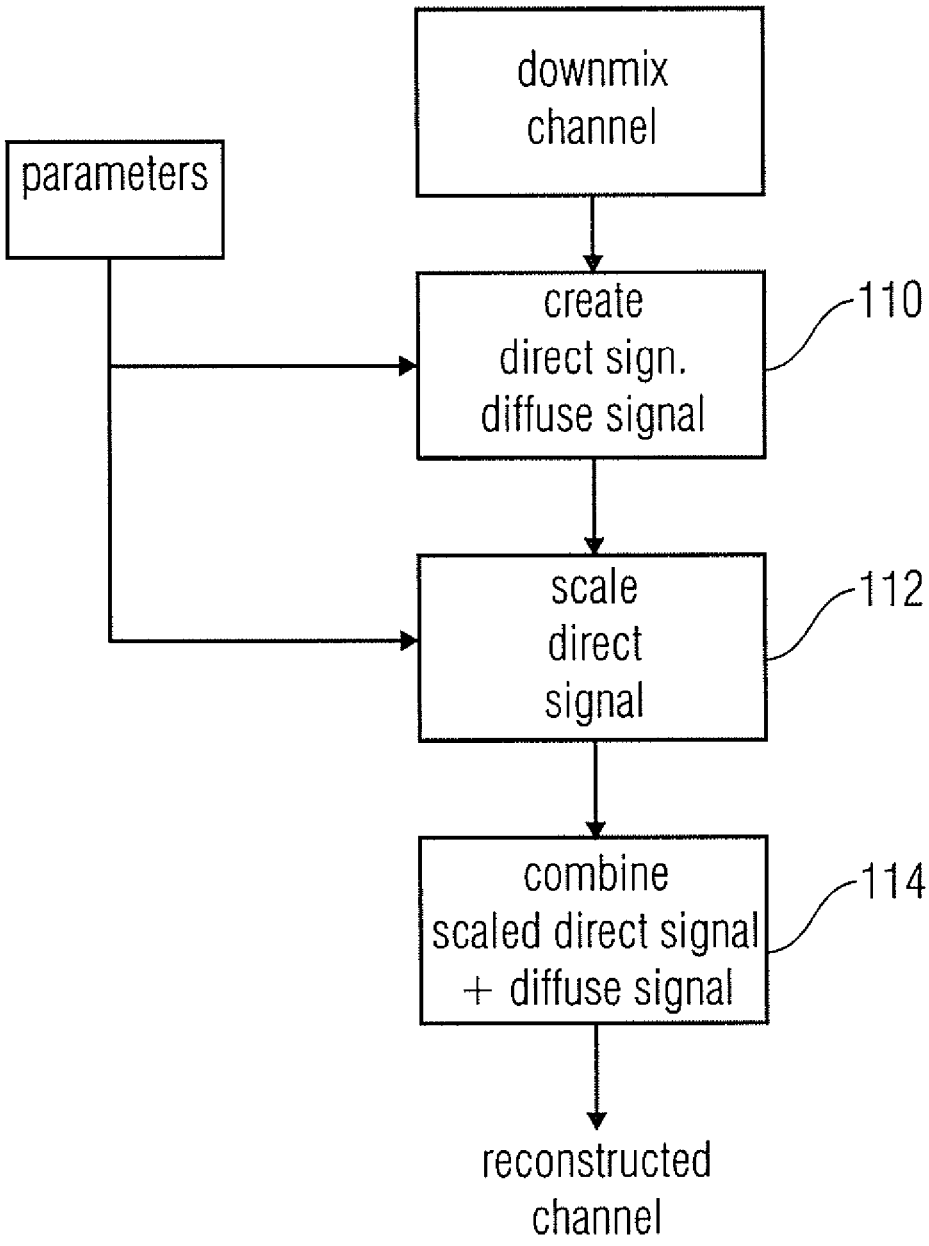
FIG. 6 shows a block diagram detailing an example for an inventive method of reconstructing an output channel.

FIG. 6 shows a block diagram, detailing the inventive method of generating a reconstructed output channel.

In a generation step 110, a direct signal component and a diffuse signal component is derived from the downmix channel in a modification step 112 the direct signal component is modified using parameters of the parameter representation having information on a temporal structure of an original channel.

In a combination step 114, the modified direct signal component and the diffuse signal component are combined to obtain a reconstructed output channel.

Depending on certain implementation requirements of the inventive methods, the inventive methods can be implemented in hardware. The implementation can be performed using a digital storage medium, in particular a disk, DVD or a CD having electronically readable control signals stored thereon, which cooperate with a programmable computer system such that the inventive methods are performed. Generally, the present invention is, therefore, a digital storage medium having stored thereon a computer program product with a program code stored on a machine readable carrier, the program code being operative for performing the inventive methods when the computer program product runs on a computer. In other words, the inventive methods are, therefore, a digital storage medium having stored thereon a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. Multi-channel reconstructor for generating a reconstructed output channel using at least one downmix channel derived by downmixing a plurality of original channels and using a parameter representation, the parameter representation including information on a temporal structure of an original channel, comprising:

a generator device for generating a direct signal component and a diffuse signal component for the reconstructed output channel, based on the at least one downmix channel;

a direct signal modifier for modifying the direct signal component using the information on the temporal structure of an original channel included in the parameter representation to obtain a modified direct signal component, wherein the diffuse signal component is not modified using the information on the temporal structure of the original channel included in the parameter representation; and a combiner for combining the modified direct signal component and the diffuse signal component to obtain the reconstructed output channel, wherein the generator device, the direct signal modifier or the combiner comprises a hardware apparatus.

2. The multi-channel reconstructor in accordance with claim 1, in which the generator is operative to generate the direct signal component using only components of the at least one downmix channel.

3. The multi-channel reconstructor in accordance with claim 1 in which the generator is operative to generate the diffuse signal component using a filtered and/or delayed portion of the at least one downmix channel.

4. The multi-channel reconstructor in accordance with claim 1, in which the direct signal modifier is operative to use information on the temporal structure of the original channel indicating an energy contained in the original channel within a finite length time portion of the original channel.

5. The multi-channel reconstructor in accordance with claim 1, in which the direct signal modifier is operative to use information on the temporal structure of the original channel indicating a mean amplitude of the original channel within a finite length time portion of the original channel.

6. The multi-channel reconstructor in accordance with claim 1, in which the combiner is operative to add the modified direct signal component and the diffuse signal component to obtain the reconstructed output channel.

7. The multi-channel reconstructor in accordance with claim 1, in which the multi-channel reconstructor is operative to use a first downmix channel having information on a left side of the plurality of original channels and a second downmix channel having information on a right side of the plurality of original channels, wherein a first reconstructed output channel for a left side is combined using only direct and diffuse signal components generated from the first downmix channel and wherein a second reconstructed output channel for a right side is combined using direct and diffuse signal components generated only from the second downmix signal.

8. The multi-channel reconstructor in accordance with claim 1, in which the direct signal modifier is operative to modify the direct signal for finite length time portions being shorter than frame time portions of additional parametric information within the parameter representation, wherein the additional parametric information is used by the generator for generating the direct and the diffuse signal components.

9. The multi-channel reconstructor in accordance with claim 8, in which the generator is operative to use additional parametric information having information on the energy of the original channel with respect to other channels of the plurality of original channels.

10. The multi-channel reconstructor in accordance with claim 1, in which the information on the temporal structure of the original channel represents a ratio between the temporal structure of the original channel and a temporal structure of the at least one downmix channel.

11. The multi-channel reconstructor in accordance with claim 1, in which the information on the temporal structure of the original channel and the information on the temporal structure of the at least one downmix channel is having an energy or an amplitude measure.

12. The multi-channel reconstructor in accordance with claim 1, in which the direct signal modifier is further operative to estimate an estimate of a temporal envelope of the at least one downmix channel.

13. The multi-channel reconstructor in accordance with claim 12, in which the direct signal modifier is operative to estimate the estimate of the temporal envelope indicating an energy contained in the at least one downmix channel within a finite length time interval or an amplitude measure for the finite length time interval.

14. The multi-channel reconstructor in accordance with claim 12, in which the direct signal modifier is further operative to derive a target temporal envelope for the reconstructed output channel using the downmix temporal envelope and scaling the downmix temporal envelope with encoder transmitted and re-quantized envelope ratios.

15. The multi-channel reconstructor in accordance with claim 12, in which the direct signal modifier is operative to derive the downmix temporal envelope for a spectral portion of the at least one downmix channel only for subbands above a spectral lower bound represented by a subband index.

16. The multi-channel reconstructor in accordance with claim 12, in which the direct signal modifier is further operative to spectrally whiten the at least one downmix channel and to derive the downmix temporal envelope using the spectrally whitened downmix channel.

17. The multi-channel reconstructor in accordance with claim 12, in which the direct signal modifier is further operative to derive a smoothed representation of the at least one downmix channel and to derive the downmix temporal envelope from the smoothed representation of the at least one downmix channel.

18. The multi-channel reconstructor in accordance with claim 17, in which the direct signal modifier is operative to derive the smoothed representation by filtering the at least one downmix channel with a first order lowpass filter.

19. The multi-channel reconstructor in accordance with claim 1, in which the direct signal modifier is further operative to derive a temporal envelope of a combination of the direct signal component and the diffuse signal component.

20. The multi-channel reconstructor in accordance with claim 19, in which the direct signal modifier is operative to spectrally whiten the combination of the direct signal and the diffuse signal components and to derive the temporal envelope of the combination of the direct signal and the diffuse signal components using the spectrally whitened direct and diffuse signal components.

21. The multi-channel reconstructor in accordance with claim 19, in which the direct signal modifier is further operative to derive a smoothed representation of the combination of the direct and the diffuse signal components and to derive the temporal envelope of the combination of the direct and the diffuse signal components from the smoothed representation of the combination of the direct and the diffuse signal components.

22. The multi-channel reconstructor in accordance with claim 21, in which the direct signal modifier is operative to derive the smoothed representation by filtering the direct and the diffuse signal components with a first order lowpass filter.

23. The multi-channel reconstructor in accordance with claim 1, in which the direct signal modifier is operative to use a temporal envelope of the original channel, the temporal envelope comprising a time sequence of values each value indicating a ratio of the energy or amplitude of the original channel for a finite length time interval and the energy or amplitude of the at least one downmix channel for the finite length time interval.

24. The multi-channel reconstructor in accordance with claim 1, in which the direct signal modifier is operative to derive a target temporal envelope for the reconstructed output channel using the at least one downmix channel and the information on the temporal structure of the original channel included in the parameter representation.

25. The multi-channel reconstructor in accordance with claim 24, in which the direct signal modifier is operative to modify the direct signal component such that a temporal envelope of the reconstructed output channel equals the target temporal envelope within a tolerance range.

26. The multi-channel reconstructor in accordance with claim 25, in which the direct signal modifier is operative to derive an intermediate scaling factor, the intermediate scaling factor being such that the temporal envelope of the reconstructed output channel equals the target temporal envelope within the tolerance range, when the reconstructed output channel is combined using the direct signal components scaled with the intermediate scaling factor and the diffuse signal component scaled with the intermediate scaling factor, wherein the intermediate scaling factor does not depend on the information on the temporal structure of the original channel included in the parameter representation.

27. The multi-channel reconstructor in accordance with claim 26, in which the direct signal modifier is further operative to derive a final scaling factor using the intermediate scaling factor and the direct and diffuse signal components such that the temporal envelope of the reconstructed output channel equals the target temporal envelope within the tolerance range, when the reconstructed output channel is combined using the diffuse signal component and the direct signal component scaled using the final scaling factor, wherein the final scaling factor does not depend on the information on the temporal structure of the original channel included in the parameter representation.

28. Method for generating a reconstructed output channel using at least one downmix channel derived by downmixing a plurality of original channels and using a parameter representation, the parameter representation including information on a temporal structure of an original channel, the method comprising:

generating a direct signal component and a diffuse signal component for the reconstructed output channel, based on the at least one downmix channel;

modifying the direct signal component using the information on the temporal structure of an original channel included in the parameter representation, to obtain a modified direct signal component, wherein the diffuse signal component is not modified using the information on the temporal structure of the original channel included in the parameter representation; and combining the modified direct signal component and the diffuse signal component to obtain the reconstructed output channel, wherein the method of generating is implemented by a hardware apparatus.

29. Multi-channel audio decoder for generating a reconstruction of a multi-channel signal using at least one downmix channel derived by downmixing a plurality of original channels and using a parameter representation, the parameter representation including information on a temporal structure of an original channel, the multi-channel audio decoder, comprising a multi-channel reconstructor in accordance with claim 1, wherein the multi-channel audio decoder is implemented as a hardware apparatus.

30. A non-transitory digital storage medium having stored thereon a computer program with a program code for performing the method of claim 28, when the computer program is running on a computer.

* * * * *